United States Patent [19]

Kirk

[11] Patent Number: 4,463,455

[45] Date of Patent: Aug. 7, 1984

[54] TWO PART ADJUSTABLE BELT WITH LOCKING MEANS

[75] Inventor: Alexis V. Kirk, New York, N.Y.

[73] Assignee: Somersett Moon Ltd., New York, N.Y.

[21] Appl. No.: 330,844

[22] Filed: Dec. 15, 1981

[51] Int. Cl.[3] ..... A41F 3/02; A41F 9/00; A41F 15/00

[52] U.S. Cl. ..... 2/338; 2/316; 2/319; 2/321; 2/322; 2/325; 24/30.5 R; 24/30.5 W; 24/129 W

[58] Field of Search ..... 2/316, 321, 319, 325, 2/322, 338; 24/30.5 R, 30.5 W, 129 W, 129 R, 570, 20 CW, 560

[56] References Cited

U.S. PATENT DOCUMENTS

| | | | |
|---|---|---|---|
| 408,179 | 7/1889 | Katzenberg | 2/311 |
| 411,416 | 9/1889 | Blakesley | 2/338 |
| 439,375 | 10/1890 | Blakesley | 2/311 |
| 583,986 | 6/1897 | Drost | 2/333 |
| 603,760 | 5/1898 | Gair | 2/338 |
| 645,756 | 3/1900 | Puellmann | 2/311 |
| 1,618,147 | 2/1927 | Carpenter | 2/322 |
| 1,653,288 | 12/1927 | Johnson | 2/326 |
| 1,908,038 | 5/1933 | MacKenzie | 2/321 |
| 2,342,210 | 2/1944 | Murphey | 2/322 |
| 2,465,536 | 3/1949 | Hyman | 2/321 |
| 2,495,029 | 1/1950 | Spengler | 2/322 |
| 2,498,685 | 2/1950 | Hyman | 2/321 |
| 2,586,457 | 2/1952 | Epstein | 2/322 |
| 2,655,707 | 10/1953 | Rubin | 2/311 |
| 3,501,775 | 3/1970 | Demers et al. | 2/321 |
| 3,591,866 | 7/1971 | Jensen | 2/321 |
| 3,866,276 | 2/1975 | Perkins | 2/311 |

FOREIGN PATENT DOCUMENTS

| | | |
|---|---|---|
| 1051757 | 3/1959 | Fed. Rep. of Germany . |

*Primary Examiner*—Werner H. Schroeder
*Assistant Examiner*—Mary A. Ellis
*Attorney, Agent, or Firm*—Frishauf, Holtz, Goodman & Woodward

[57] ABSTRACT

An adjustable two part belt with locking means comprises elongated belt members which overlap each other and transverse members connected to the ends of the overlapping portions of the belt members and at least partially encircling the corresponding portions of the belt members. At least one of the transverse members includes a clamp means in the form of a metallic strip which encircles at least a portion of the overlapping belt members and which is bendable to clamp the overlapping portions of the belt members against each other to maintain the length adjustment of the belt. The metallic strip means is preferably in a C-shape.

14 Claims, 7 Drawing Figures

FRONT SIDE OF BELT

FRONT SIDE OF BELT

FRONT OF BELT

FRONT
REAR

FRONT
REAR

TWO PART ADJUSTABLE BELT WITH LOCKING MEANS

BACKGROUND OF THE INVENTION

This invention relates to a two part adjustable belt, and more particularly to such a belt with locking means for retaining the adjusted position of the belt.

Adjustable belts are known. For example, a two part adjustable belt has been known for many years. However, a difficulty has existed in that when the known two part belts are set to the adjusted position, the two parts of the belt may slip and/or slide relative to each other, thereby losing the adjustment. While locking mechanisms for belts are known, such mechanisms are bulky, unattractive or difficult to use, thereby rendering them unsuitable for use in the known two part adjustable belts.

The object of the present invention is to provide a two part adjustable belt with locking means for maintaining the adjusted position of the belt. It is a further object to provide such locking means in an invisible manner and which may be easily actuated by the user, and which maintains its locked position over long periods of use.

SUMMARY OF THE INVENTION

According to the present invention, a two part adjustable belt with locking means, comprises first and second elongated belt members, a portion of the length of the first and second belt portions overlapping each other; first and second transverse members at least partially encircling a portion of the overlapping portions of the first and second belt portions; means connecting one of the tranverse members to an end portion of one of the belt members; and means connecting the other of the transverse members to an end portion of the other of the belt members. At least one of the tranverse members includes clamp means for claimping the overlapping belt portions relative to each other to substantially prevent relative sliding movement between the overlapping portions of the first and second belt members, the clamping means comprising metallic strip means encircling at least a portion of the overlapping belt members and being bendable to clamp the overlapping portions of the belt members against each other upon bending of the metallic strip means, thereby maintaining the length adjustment of the belt.

DETAILED DESCRIPTION

Figures 1, 2, 3, 4, 5, 6, 7:
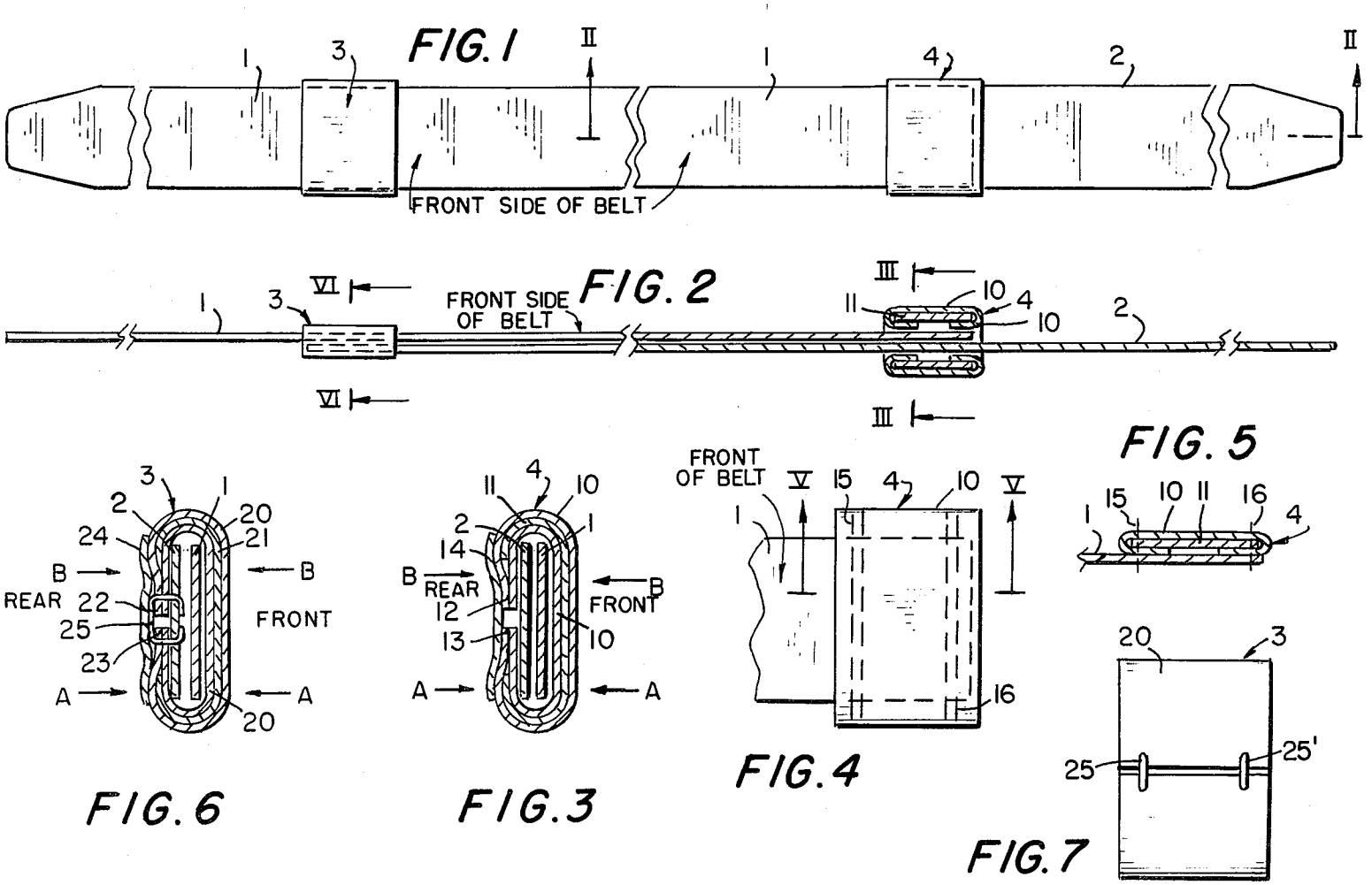
FIG. 1 is an elevational view of a two part belt according to the present invention.
FIG. 2 is a sectional view thereof, one portion being shown in exaggerated form.
FIG. 3 is a sectional view of a portion of FIG. 2 taken along the lines III—III.
FIG. 4 is an elevational view of a portion of the embodiment of FIG. 1, shown with slight modification.
FIG. 5 is a part sectional view of the embodiment of FIG. 4 taken along the lines V—V.
FIG. 6 is a sectional view of a portion of FIG. 2 taken along the lines VI—VI.
FIG. 7 is a rear view of transverse member 3 of FIG. 6, with the decorative covering layer removed.

Referring to FIGS. 1 and 2, the two part belt of the present invention comprises two belt members 1,2 and two transverse guide members 3,4 with respective locking means therein. As seen from FIGS. 1 and 2, belt member or portion 1 is slidable in transverse member 3 and is visibly connected to transverse member 4, whereas belt portion 2 is slidable in transverse member 4 behind belt portion 1 (FIG. 2) and is connected to transverse member 3. The size of the belt is adjusted to a larger size merely by pulling on the free ends of belt portions 1,2, causing the belt portions to slide within their respective transverse members 3,4, thereby bringing the transverse members 3,4 closer to each other and enlarging the belt. The belt is reduced in size by performing the opposite operation—that is, pushing the belt members 1,2 toward each other (more easily done by pulling the transverse members 3,4 further away from each other).

As seen from FIGS. 2 and 3, which show exploded sectional views of the transverse member 4, the transverse member 4 encircles belt portions 1,2, belt portion 1 being secured to the inner surface of transverse member 4, for example by adhesive or by other means as shown, for example in FIGS. 4 and 5 which will be discussed hereinbelow. The transverse member 4 comprises an outer layer 10 which wraps around an inner metallic strip 11, the outer layer 10 being made of leather or other material which is either the same as that of the belt, or of different material from the belt. Preferably, the outer layer 10 is decorative in nature. As seen from FIGS. 2 and 3, the outer layer 10 preferably wraps around and covers the inner portion of the metal strip 11, as seen in FIGS. 2 and 3. The ends 12,13 of the outer layer 10 may be adhered together (the inner surface to the outer surface) for example by means of an adhesive, as seen in FIG. 3. An inner finishing layer 14 may be adhered to the inner surface of transverse member 4, as shown in FIG. 3, by means of an adhesive for example, to cover the free exposed ends of the layer 10, thereby improving appearance of the device. As seen in FIGS. 2 and 3, belt portion 1 has its end fixedly connected to the transverse member 4 (by an adhesive or by other means as described below with respect to FIGS. 4 and 5), and belt portion 2 is slidably drawn through the interior of transverse member 4, as seen in FIGS. 2 and 3.

Referring to FIG. 4, a method for securing the end of belt member 1 to transverse member 4 is illustrated. The metal strip 11 is designated by chain lines in FIG. 4 and stitching (for example sewing machine stitching) is designated by dashed lines 15,16. As better seen in FIG. 5, which is a partial sectional view of FIG. 4, the stitching 15,16 passes through the outer layer 10 at the portions adjacent the side edges of metal strip 11, and passes through the end of belt portion 1, thereby fixing belt portion 1 to the transverse member 4. As mentioned above, in place of stitching, adhesives could be used to connect belt portion 1 to transverse member 4.

FIG. 6 is an exploded sectional view of the transverse member 3 which encircles belt portions 1,2, and which is fixedly attached to belt portion 2. Belt portion 1 is slidable through encircling transverse member 3. Transverse member 3 comprises an outer layer 20 which wraps around an inner metallic strip 21, in the same manner as described above with respect to transverse member 4 (outer layer 10) shown in FIGS. 2 and 3. Outer layer 20 is substantially identical to outer layer 10. The free ends 22,23 of the outer layer 20, which project beyond the end of metallic strip 21, are pierced by means of a staple 25, the legs of which continue through outer layer 20 and pierce the end portion of belt portion 2, as shown in FIG. 6. The remote free ends of staple 25 are then bent over so as not to pierce belt portion 1. Belt portion 1, as mentioned above, is slidable relative to belt portion 2 through the inner free open area of transverse member 3. One or more staples can be provided along the length of transverse member 3, for example as shown in FIG. 7 which illustrates two staples 25'. As seen in FIG. 6, a rear decorative covering member 24, which may be of the same material as the outer layer 20, is adhered to the inner surface of transverse member 3, for example by an adhesive, to cover the staples 25,25'.

Instead of stampling the end portion of belt portion 2 to transverse member 3, the connection may be made by means of an adhesive or other connecting elements.

The belt is used as follows: when the belt is adjusted to the proper size, the end U-shaped portions of the strips 11,21 (see FIGS. 3 and 6) are squeezed together in the direction of the sets of arrows A and B. This essentially clamps the tranverse member against belt portions 1,2, thereby squeezing them together preferably in a substantially non-resilient manner, thereby preventing the belt portions from inadvertently sliding relative to each other. Of course, if great forces are applied to the belt portions, it may be possible to overcome the retaining force of the metallic strips 11,21, to permit the belt portions to more relative to each other. However, under normal usage as a belt, such great forces are not applied and it has been found that the metallic strips 11,21 provide sufficient clamping forces to maintain the belts in proper relative positions.

The metallic strips 11,21 may be made preferably of steel or the like which, when bent, tends to keep the bent shape. Other types of metals can be used. The basic requirement is that the metal used should be sufficiently bendable by means of finger pressure of the user (or a small pair of pliers) to clamp the belt portions 1,2 together, and which retains the clamping force after being bent.

The belts 1,2 are shown as single layer structures in the figures. However, they may be multi-layer structures of leather or other synthetic materials as is generally known in the belt art. Also, the outer layers of the transverse layers 3,4 can be material such as leather, synthetics, or other suitable materials. Instead of the outer layers 10,20 completely encircling the respective metal strips 11,21, the metal strips 11,21 can be covered only on their outer side or on the outer side and edge portions to provide a finished appearance. The metallic strips may also be coated with a material for example dipped in a plastic to become plastic coated, and may be used directly with the belt portions 1,2, the adhering of the belt portions to the thus modified metallic strips being accomplished by means of adhesive, staples, rivets, or other suitable means, consistent with appearance requirements.

The clamping metal strips 11,21 may be provided in only one transverse member, but better clamping is achieved with metal strips in both transverse members 3,4.

While the invention has been described above with respect to specific embodiments, it should be clear that various modifications and alterations can be made within the scope of the invention as defined in the appended claims.

I claim:

1. A two-part adjustable belt with locking means, comprising:

first and second elongated belt members (1, 2), a portion of the length of said first and second belt members overlapping each other, said overlapping belt portions having longitudinal opposite side edges substantially aligned with each other, and said belt members each having first and second substantially flat opposing faces, the first opposing faces of each of said belt members contacting each other at said overlapping portions, and said second opposing faces of said belt members facing away from each other;

first and second transverse members (3, 4) substantially completely encircling a portion of the overlapping portions of said first and second belt members;

means connecting one of said transverse members (3) to an end portion of one of said belt members (2);

means connecting the other of said transverse members (4) to an end portion of one of said belt members (1);

at least one of said transverse members (3, 4) including a generally C-shaped metallic strip clamp means (11, 21) for clamping said overlapping belt portions to each other to substantially prevent relative sliding movement between said overlapping portions of said first and second belt members, said generally C-shaped metallic strip having a body portion and free arm portions extending from said body portion, said C-shaped metallic strip encircling at least a portion of said overlapping belt members and extending continuously around said aligned edges on both sides of said overlapping belt portions such that continuously connected portions of said C-shaped metallic strip clamp means contacts both of said second faces of said overlapping belt portions with said free arm portions contacting the same second face and clamps said second faces toward each other so that said first faces of said overlapping belt portions are pressed toward each other and clampled in contact with each other to prevent relative movement therebetween, said metallic strip clamp means being bendable to clamp said overlapping portions of said belt members against each other upon bending of said free arms of said metallic strip toward said body portion of the metallic strip, thereby maintaining the length adjustment of said belt.

2. The belt of claim 1, wherein both of said first and second transverse members each comprise one of said C-shaped metallic strip bendable clamp means which substantially encircles at least a portion of said overlapping belt members.

3. The belt of claim 1, wherein said C-shaped metallic strip clamp means comprises a substantially flat metallic strip and a decorative covering means over said metallic strip, said decorative covering means being connected to the respective ends of said belt members (2,3).

4. The belt of claim 3, wherein said decorative covering means is stitched to the end portion of the respective belt member.

5. The belt of claim 4, wherein both of said first and second transverse members each comprise one of said C-shaped metallic strip bendable clamp means which substantially encircles at least a portion of said overlapping belt members.

6. The belt of claim 5, wherein said decorative covering means of said first transverse member is stitched to an end portion of one of said belt members on the front side of said adjustable belt, and said transverse member is fixedly connected to the end of the other of said belt members.

7. The belt of claim 3, wherein said decorative covering means is a sheet-like covering means over said metallic strip and extending past at least one longitudinal edge of said metallic strip, said extending portion of said decorative sheet-like covering stitched to the end portion of a respective belt member.

8. The belt of claim 7, wherein said decorative sheet-like covering extends past both opposite longitudinal edges of said metallic strips.

9. The belt of claim 1, wherein said free arms of said metallic strip are closely adjacent each other on said same second face of said overlapping belt portions.

10. The belt of claim 3, wherein said free arms of said metallic strip are closely adjacent each other on said same second face of said overlapping belt portions.

11. The belt of claim 1 or 3, wherein said first transverse member is stitched to an end portion of one of said belt members on the front side surface of said adjustable belt, and said second transverse member is fixedly connected to said other of said belt members.

12. The belt of claim 11, wherein said second transverse member is stapled to said end of said other of said belt members.

13. The belt of claim 1 or 3, wherein said metallic strip means is a steel strip.

14. The belt of claim 1 or 3, wherein said at least one transverse member comprises decorative covering means over said metallic strip means.

* * * * *